US010611170B2

(12) United States Patent
Odin et al.

(10) Patent No.: US 10,611,170 B2
(45) Date of Patent: Apr. 7, 2020

(54) DEVICE FOR MEASURING OVERFLOW FROM A GUTTER OF A PRINT HEAD OF AN INK JET PRINTER

(71) Applicant: Dover Europe Sàrl, Vernier (FR)

(72) Inventors: Florence Odin, Montelier (FR); Damien Bonneton, Hostun (FR)

(73) Assignee: DOVER EUROPE SÁRL, Vernier (CH)

( * ) Notice: Subject to any disclaimer, the term of this patent is extended or adjusted under 35 U.S.C. 154(b) by 0 days.

(21) Appl. No.: 16/008,754

(22) Filed: Jun. 14, 2018

(65) Prior Publication Data

US 2018/0361753 A1 Dec. 20, 2018

(30) Foreign Application Priority Data

Jun. 16, 2017 (FR) ..... 17 55512

(51) Int. Cl.

| | |
|---|---|
| ***B41J 2/02*** | (2006.01) |
| ***B41J 2/09*** | (2006.01) |
| ***B41J 2/185*** | (2006.01) |
| ***B41J 2/20*** | (2006.01) |
| ***B41J 2/125*** | (2006.01) |

(Continued)

(52) U.S. Cl.

CPC ..... *B41J 2/185* (2013.01); *B41J 2/03* (2013.01); *B41J 2/09* (2013.01); *B41J 2/125* (2013.01); *B41J 2/17523* (2013.01); *B41J 2/17596* (2013.01); *B41J 2/20* (2013.01); *B41J 2002/022* (2013.01); *B41J 2002/1853* (2013.01); *B41J 2002/1856* (2013.01)

(58) Field of Classification Search

CPC ..... B41J 2/02; B41J 2/035; B41J 2/075; B41J 2/085; B41J 2/09; B41J 2/115; B41J 2/12; B41J 2/125; B41J 2002/022; B41J 2002/1853

See application file for complete search history.

(56) References Cited

U.S. PATENT DOCUMENTS 3,898,673 A 8/1975 Haskell
4,631,550 A * 12/1986 Piatt ..... B41J 2/125 347/80

(Continued)

FOREIGN PATENT DOCUMENTS

FR 2825650 A1 12/2002
GB 2479751 A 10/2011

OTHER PUBLICATIONS

European Search Report for EP 18 17 7898 dated Oct. 5, 2018.

(Continued)

*Primary Examiner* — Scott A Richmond
(74) *Attorney, Agent, or Firm* — Pearne & Gordon LLP

(57) ABSTRACT

A print head of a continuous ink jet printer, including, in a cover: means for producing at least one ink jet; means for separating drops of jets intended for printing from those that do not serve for printing; a slot, enabling drops intended for printing to get out; a recovery gutter (7) for drops not intended for printing, the recovery gutter comprising an ink recovery volume (12); at least one detection conductor (20), arranged inside the head; means (16) for detecting a variation in impedance of at least one of the detection conductors when ink (21) is present in contact with the conductor or with a dielectric layer (22) in contact therewith.

17 Claims, 7 Drawing Sheets

(51) Int. Cl.

| | |
|---|---|
| ***B41J 2/03*** | (2006.01) |
| ***B41J 2/175*** | (2006.01) |

(56) References Cited

U.S. PATENT DOCUMENTS

| | | | |
|---|---|---|---|
| 2018/0022104 | A1 | 1/2018 | Bonneton |
| 2018/0032718 | A1 | 2/2018 | Soto et al. |
| 2018/0162121 | A1 | 6/2018 | Bonneton |

OTHER PUBLICATIONS

Written Opinion for EP 18 17 7898 dated Oct. 5, 2018.
French Search Report for FR 1755512 dated Feb. 14, 2018.
U.S. Appl. No. 61/243,513, filed Sep. 17, 2009.
U.S. Appl. No. 61/469,280, filed Mar. 30, 2011.
Communication pursuant to Article 94(3) EPC for European Application No. 18 177 898.6 dated Oct. 8, 2019.

* cited by examiner $V_5 = 0$

DEVICE FOR MEASURING OVERFLOW FROM A GUTTER OF A PRINT HEAD OF AN INK JET PRINTER

CROSS-REFERENCE TO RELATED APPLICATIONS

This application claims priority from French Patent Application No. 17 55512 filed on Jun. 16, 2017. The content of this application is incorporated herein by reference in its entirety.

TECHNICAL FIELD AND PRIOR ART

The invention notably applies to print heads of printers or to deviated continuous ink jet printers or to binary continuous ink jet printers provided with a multi-nozzle drop generator.

Continuous ink jet printers comprise an ink drop generator, and means, comprising one or more electrodes, for separating the trajectories of the drops produced by the generator and directing them to a printing support or to a recovery gutter.

The drop generator includes one nozzle or several nozzles aligned on a nozzle plate along an X axis of alignment of the nozzles. During printing, jets of ink are ejected in a continuous manner by these nozzles in a direction Z perpendicular to the nozzle plate. Among continuous ink jet printers may be distinguished deviated continuous ink jet printers and binary continuous ink jet printers. In deviated continuous ink jet printers, the drops formed from a nozzle throughout the duration of printing of a position of a printing support are deviated or not deviated. For each printing position and for each nozzle, a segment perpendicular to the direction of the movement of the printing support is printed. The deviated drops are deviated in such a way that they are going to strike the printing support on the part of the printed segment that has to be printed taking account of the pattern to print. The non-deviated drops are recovered by a recovery gutter. Deviated continuous ink jet printers in general comprise few ejection nozzles, but each nozzle can print, for each printing position of the support, several pixels spread out on the printing segment as a function of the pattern to print. In binary continuous ink jet printers, the ink coming from a nozzle only prints one pixel per printing position. The considered pixel does not receive any drop or receives one or several drops, as a function of the pattern to print. Hence, for good printing rapidity, the nozzle plate comprises a large number of nozzles, for example 64, enabling the simultaneous printing of as many pixels as nozzles. The drops not intended for printing are recovered by a recovery gutter.

Anomalies can occur during the recovery of ink by the gutter. A flow of ink may for example take place, from the gutter, onto the product to print ("support") or onto installations associated with the printer, for example a conveyor that transports the objects to mark. Another problem may be the filling of the print head with ink, if the ink is not recovered by the gutter; in the head, in fact, voltages of several hundreds of volts (for example between 500 V and 1000 V) are brought into play, to supply the various charge or drop deviation electrodes.

Furthermore, no means are available making it possible to identify a correct recovery of ink of a jet in the gutter. Information relative to good recovery of the jet is rather deduced from the regular variation in the impedance of a vein of ink in the suction ("recovery") circuit of the ink from the head to the circuit of ink situated in the console of the machine.

The document Hitachi JP 2014193568 describes a detector making it possible to detect a state of overflow of a gutter by a phase measurement of charged particles that enter into the gutter. A metal part arranged in the vicinity of the inlet of the gutter makes the drops of ink that contribute to the overflow lose the charge they are carrying.

This technique is not always suitable, notably in the following cases:

- when there is a need to detect the limit case where the jet brushes against the edge of the gutter (while being essentially in said gutter), which occurs when the recovery is of sufficiently good quality so as not to declare a defect; and, moreover, the projections of ink resulting from brushing against suffice to provoke phenomena of drops at the end of the recovery gutter: the jet can verge on the gutter, causing splashes which can lead to the accumulation of micro-droplets, which are going to form a construction of non-volatile matter leading to deviation of the jet.

Furthermore, no means are available making it possible to identify a projection of ink on any surface of the print head. Yet such information may be very useful for deciding the correct operation of the head or to intervene to clean the interior of the head. In addition, such a projection translates a loss of ink, which is costly.

BRIEF DESCRIPTION OF THE INVENTION

The present invention firstly relates to an ink recovery gutter, for recovering drops or sections of ink not intended for printing, said ink recovery gutter comprising:

- an ink recovery volume;
- at least one conductive element, designated detection conductor, fixed to, or fixed with respect to, or arranged against, a surface of the gutter exterior to the ink recovery volume and/or at least one conductive element, designated detection conductor, arranged between the gutter and a cover of a print head;
- means for detecting a variation in impedance of at least one of said detection conductors when ink or solvent is present in contact with said at least one conductive element or with a dielectric layer in contact therewith.

The present invention also relates to a print head of a continuous ink jet printer comprising, in a cover:

- means for producing at least one ink jet;
  - means for separating the drops or sections of jet, intended for printing, from the drops or sections that do not serve for printing;
  - a slot, open to the outside of the print head and enabling drops or sections of ink intended for printing to get out;
  - an ink recovery gutter, for recovering drops or sections of ink not intended for printing, said ink recovery gutter comprising an ink recovery volume.

According to one aspect of the invention, the print head may comprise at least one conductive detection element (or conductor), for example fixed to, or fixed with respect to, or arranged against, an interior surface of the print head, or further for example, arranged between the gutter and the cover of the print head.

At least one such conductive detection element, or conductor, may notably be arranged:

against an interior surface of the cover;

or against a surface of the recovery gutter, said surface being exterior to the ink recovery volume, said conductive element being able to receive overflows of ink from the gutter;

or at a distance from the gutter and from the cover and/or from the means for producing at least one ink jet, between said gutter and said cover or between said gutter and said means for producing at least one ink jet.

Means may be provided for detecting a variation in impedance at the terminals of at least one of said detection conductors when charged or non-charged ink or solvent is present in contact therewith or with a dielectric layer in contact therewith.

In a gutter or a print head according to the invention:

voltage supply means may be provided for applying to the terminals of at least one of said detection conductors at least one voltage (Vc);

and/or at least one of said conductive detection elements, or conductors, may be of resistive type (embodiment that functions particularly well in the case of a conducting ink) or instead of capacitive type (embodiment for any liquid);

and/or at least one of said conductive detection elements, or conductors, may be arranged against an interior surface of the print head, for example against a surface of the gutter, exterior to the ink recovery volume or between the gutter and the cover of the print head, or instead between the gutter and the means for producing at least one ink or solvent jet.

Thus the invention concerns in particular a print head of a continuous ink jet printer comprising, in a cover:

means for producing at least one ink or solvent jet;

means for separating the drops or sections of at least one jet, intended for printing, from the drops or sections that do not serve for printing;

a slot, open to the outside of the print head and enabling the drops or sections of ink intended for printing to get out;

an ink recovery gutter, for recovering the drops or sections of ink not intended for printing, said ink recovery gutter comprising an ink recovery volume;

at least one conductive detection element, arranged inside the print head:

against an interior surface of the cover;

or against a surface of the recovery gutter, exterior to the ink recovery volume, said conductive element being able to receive overflows of ink from the recovery gutter;

or at a distance from the recovery gutter and/or from the cover and/or from the means for producing at least one ink jet, between said recovery gutter and the cover or between said recovery gutter and the means for producing at least one ink or solvent jet;

means for detecting a variation in impedance of at least one conductive detection elements, when charged or non-charged ink or solvent is present in contact therewith or with a dielectric layer in contact therewith.

At least one of said conductive detection elements, or conductors, may form a resistive impedance. In this case, means may be provided to apply a voltage to the terminals of at least one of said conductive elements, a variation in this voltage translating a variation in impedance. In other words, the means for detecting a variation in impedance comprise means for detecting a variation in this voltage.

At least one of said conductive detection elements may form, with another conductive element, a capacitive impedance. In this case, means may be provided to apply a voltage to the terminals of said capacitive impedance, a variation in this voltage translating a variation in impedance. In this case, the means for detecting a variation in impedance comprise means for detecting a variation in this voltage (for example: a voltmeter).

The recovery gutter may further comprise at least one further conductive element, or conductor, for identifying the presence of ink in the recovery gutter, said further conductive element being mounted in parallel with said at least one conductive detection element.

A gutter or a print head according to the invention may comprise a plurality of conductive elements fixed to, or arranged against, said surface of the print head, for example a gutter surface exterior to the ink recovery volume, or arranged between the gutter and the cover of the print head.

Voltage supply means may make it possible to supply different conductive detection elements with different voltages in amplitude and/or in frequency.

The means for detecting a variation in impedance when ink is present in contact with at least one of said conductive detection elements, or with a dielectric layer in contact therewith, may make it possible to localise at least one conductive detection element of which the impedance varies.

The gutter or head surface against which at least one conductive element is arranged or with respect to which it is fixed may be made:

of a non-electrically conducting material:

or of an electrically conducting material, said conductive detection element being arranged against a non-electrically conducting layer, itself arranged against said surface or in one or several housings formed in a wall or in said surface.

According to another aspect of the invention, which may be taken in combination, or not, with the first aspect above, means for moving the gutter in a print head may be provided. Moreover, means for detecting, preferably by electrical contact, the position of the gutter may be provided. This position is a function of movement of the gutter in a print head.

In other words, according to one embodiment, a print head according to the invention may comprise means for moving the recovery gutter in the print head and means for detecting the position of the recovery gutter by electrical contact.

According to one embodiment, the means for detecting the position of the recovery gutter comprise at least one first conductive element, fixed with respect to the print head, which comes, in a $1^{st}$ position of the recovery gutter, into contact with at least one conductive element, fixed with respect to the recovery gutter.

A print head according to the invention may comprise:

at least one third conductive element, fixed with respect to the recovery gutter, which comes, in a $2^{nd}$ position of the recovery gutter, different from said 1st position, into contact with said at least one first conductive element, fixed with respect to a print head;

and/or at least the second conductive element, connected to means for detecting a variation in impedance when ink is present in contact therewith or with a dielectric layer in contact therewith.

In one embodiment in which the two aspects of the invention described above are combined, switching means may be provided to switch at least the second conductive element, fixed with respect to the recovery gutter, either as conductive element for detecting the position of the recovery gutter or as conductive detection element for detecting the presence of ink in contact with said second conductive element or with a dielectric layer in contact therewith. A same conductor may thus be successively a conductor for detecting the presence of ink or dirt in the head and a conductor for detecting the position of the gutter.

In a method for operating such a device it is possible to switch the second conductive element, fixed with respect to the gutter, as conductive element for detecting the position of the gutter then as conductive element for detecting the presence of ink in contact with said second conductive element.

A print head according to the invention may comprise n nozzles for producing n ink jets, "n" being for example equal to 1, or n>1, for example greater than or equal to 16 or to 32 or to 64, etc.

The invention also relates to a method for operating, or printing, an ink recovery gutter, or (with) a print head, for example such as they have just been described above, wherein charged or non-charged ink, for example at least one drop or at least one section of ink, comes into contact with at least one conductive element, fixed to, or fixed with respect to, or arranged against, an interior surface of the head, for example a surface of a gutter exterior to the ink recovery volume of said gutter.

A variation in impedance, for example detected through a variation in voltage applied to at least one of said conductors, makes it possible to detect the presence of this ink.

The invention also relates to a method for detecting the presence of ink, on an interior surface of a print head of a continuous ink jet printer, or a method for detecting the presence of ink between said gutter and the cover or the means for forming ink jets, said method comprising:

- the application, to at least one conductive detection, fixed to, or fixed with respect to, or arranged against, said surface or arranged between the gutter and the cover or the means for forming ink jets, of at least one voltage (Vc);
- the detection of at least one variation in impedance at the terminals of at least one of said detection conductors when charged or non-charged ink is present in contact with said at least one conductive element or with a dielectric layer in contact therewith.

At least one such conductive detection element may notably be arranged:

- against an interior surface of the cover;
- or against a surface of the recovery gutter, said surface being exterior to the ink recovery volume, said conductive element being able to receive overflows of ink from the gutter;
- or at a distance from the recovery gutter and/or from the cover and/or from the means for producing at least one ink jet, between said recovery gutter and the cover or between said recovery gutter and the means for producing at least one ink or solvent jet.

Different conductive elements of a plurality of conductive detection elements may be supplied with different voltages in amplitude and/or in frequency. It is then possible to localise at least one of said conductors, the impedance of which varies on account of a projection or dirt or an overflow of ink, by means of supplying by different voltages in amplitude and/or in frequency.

A method according to the invention may be implemented simultaneously with printing operations on a printing support, by means of the print head or by means of a print head to which the gutter according to the invention belongs.

BRIEF DESCRIPTION OF THE DRAWINGS

An exemplary embodiment of the invention will now be described with reference to the appended drawings in which.

In the figures similar or identical technical elements are designated by the same reference numbers.

DETAILED DESCRIPTION OF EMBODIMENTS

A structure of print head 10, to which the invention may be applied, is explained below, in relation with FIG. 1.

The head includes a drop generator 1. Said generator comprises a nozzle plate 2 on which are aligned, along an X axis (contained in the plane of the figure), a whole number n of nozzles 4, of which a first $\mathbf{4}_1$ and a last nozzle $\mathbf{4}_n$. But the invention also applies to the case of a single nozzle.

Figure 1:
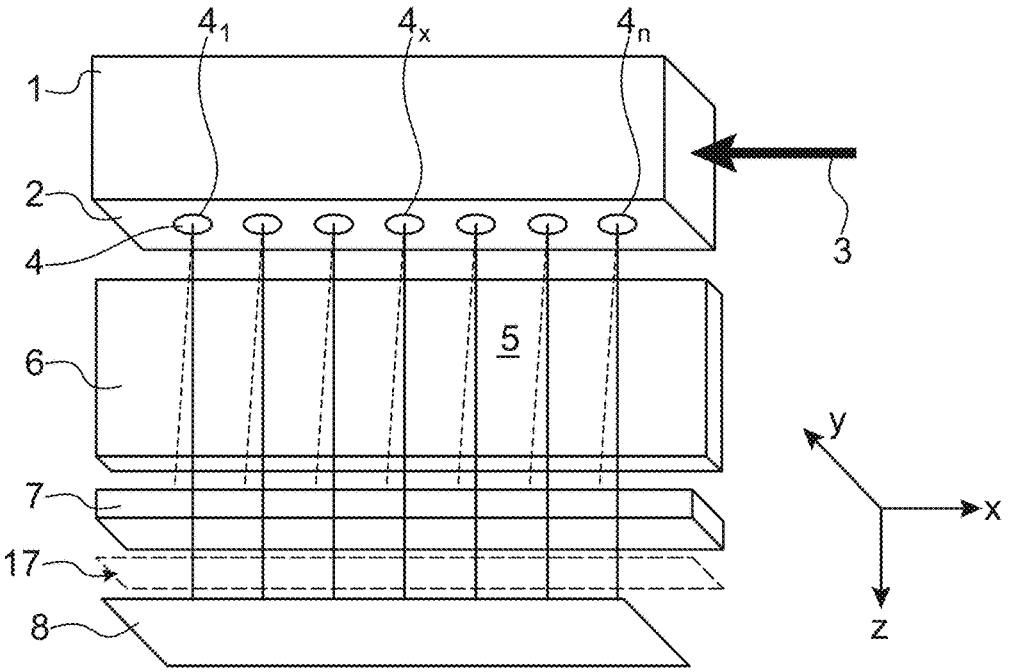
FIG. 1 represents a schematic cavalier view of a print head mainly revealing the components of the print head situated downstream of the nozzles.

In the representation of FIG. 1, the first and last nozzles ($\mathbf{4}_1$, $\mathbf{4}n$) are the nozzles the furthest away from each other.

Each nozzle has an axis of emission of a jet parallel to a direction or a Z axis (situated in the plane of FIG. 1), perpendicular to the nozzle plate and to the X axis mentioned previously. A third axis, Y, is perpendicular to each of the two axes X and Z, the two axes X and Z extending in the plane of FIG. 1.

In the figure may be seen the nozzle $\mathbf{4}_x$. Each nozzle is in hydraulic communication with a pressurised stimulation chamber. The drop generator comprises as many stimulation chambers as nozzles. Each chamber is equipped with an actuator, for example a piezo-electric crystal. An example of design of stimulation chamber is described in the document U.S. Pat. No. 7,192,121.

Downstream of the nozzle plate are located means, or sorting unit, 6 which make it possible to separate drops intended for printing from drops or sections of jets that do not serve for printing. Said means or sorting unit may comprise one or more electrodes This separation may be done without charging of the drops or sections of jets, as explained in the document FR2906755 or U.S. Pat. No. 8,162,450. In other words, in such case, the cavity does not contain an electrode for charging drops or sections of ink. The ink which is deviated to the gutter is thus not charged.

In other embodiments, as in continuous ink jet printers, drops are formed, charged (with at least one charge electrode) and then deviated (with at least one deviation electrode) or not, depending on whether they are for printing or not (in which case they are recovered in a gutter).

These means for separating drops or sections of one or several of said jets intended for printing from drops or sections that do not serve for printing may comprise at least one electrode formed against, or in, a wall which delimits the cavity in which the jets are produced. At least one electrode may be flush with the surface of the wall in question. Thus the drops or sections that do not serve for printing are deviated by electrostatic effect of at least one electrode on the drops.

The drops emitted or sections of jets emitted by a nozzle and intended for printing follow a trajectory along the Z axis of the nozzle and are going to strike a printing support 8, after having gone through an outlet slot 17. This slot is open to the outside of the cavity and enables drops of ink intended for printing to get out; it is parallel to the direction X of alignment of the nozzles, the axes of direction Z of the nozzles passing through this slot, which is located on the face opposite to the nozzle plate 2. It has a length at least equal to the distance between the first and the last nozzle.

In the present application, the term "cavity" designates the zone of space in which ink flows between the nozzle plate 2 and the outlet slot 17 of drops intended for printing or between the nozzle plate and the recovery gutter. The nozzle plate 2 in fact forms an upper wall of the cavity. Laterally, the cavity is delimited by lateral walls, substantially parallel to the curtain of jets constituted by the different jets emitted by the nozzles. One of these walls has already been evoked above, in relation with a jet deviation electrode.

The drops, or sections of jets, emitted by a nozzle and not intended for printing, are deviated by the means 6 and are recovered by a recovery gutter 7 then this ink is recycled. The gutter has, in the direction X, a length at least equal to the distance between the first and the last nozzle.

Figure 2A:
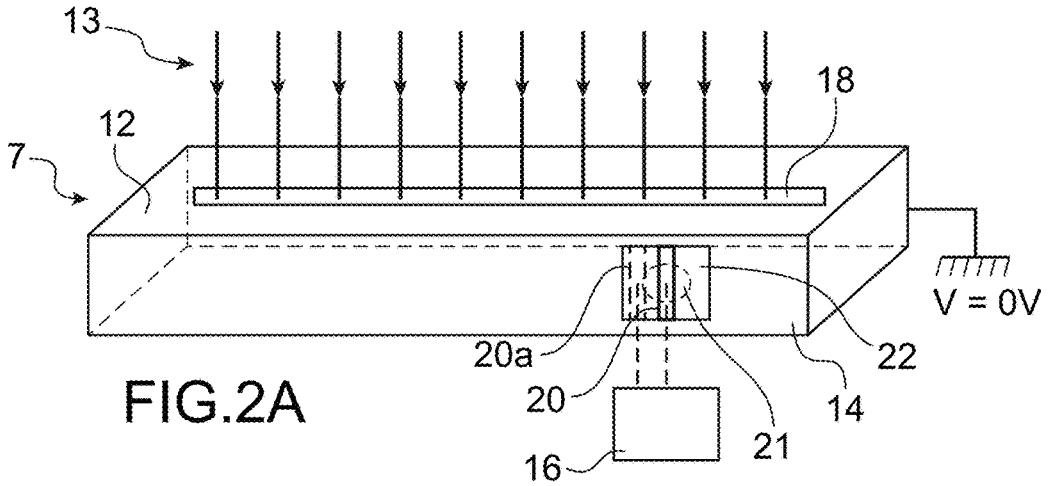
FIGS. 2A and 2B represent embodiments of gutters according to the invention.

A view of a recovery gutter according to a first aspect of the invention is explained in a more detailed manner below, in relation with FIGS. 2A and 2B.

The recovery gutter is here represented with a substantially parallelepiped shape, but other shapes may be envisaged, in particular with one or several exterior walls of curved shape.

It comprises an opening 12, designated upper opening, which collects the jets of the curtain 13 of jets. A slot 18 makes it possible to suck up the ink that has been deposited inside the gutter by the different jets. This slot is connected to a conduit, not represented in the figures, and to means, for example a pump or pumping means, to form a depression in the hollow volume 13 arranged inside the gutter. This hollow volume 13 makes it possible to collect a certain volume of ink. The opening 12 and the volume 13 form a channel or an ink recovery volume.

On a surface 14 of the recovery gutter, exterior to the channel or to the recovery volume or situated outside of said channel or volume, is provided a resistance, or, more generally, an electrode or a conductive element 20. This exterior surface 14 is not intended to receive ink; but flows or projections of ink may occur: consequently, the ink can then flow onto the exterior surface 14 and, from there, onto other parts of the printer or onto the support to print.

Figure 2B:
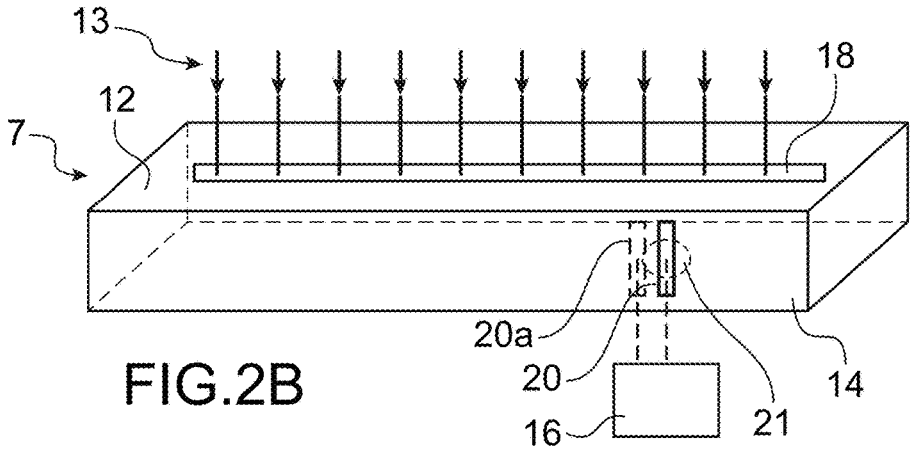

If the recovery gutter is made of an insulating or non-electricity conducting material, the conductive element 20 may be arranged directly in contact with the exterior surface 14 of the recovery gutter (FIG. 2B). If, on the other hand, the gutter is made of conducting material, the conductive element 20 is separated from the exterior surface 14 by an insulating portion 22 (FIG. 2A), for example in the form of a layer of non-conducting material applied against the surface 14. The conductive element 20 is applied against this insulating portion 22, which has a certain lateral extension on the sides of the conductive element 20.

Between the terminals of the latter may be applied a polarisation voltage Vc by means of power-on means, or a circuit, 16. These means, or this circuit, may comprise other elements, as explained below, for measuring a variation in voltage (or a variation in current) when ink is in contact with the conductive element 20. The polarisation voltage Vc may be of the order of several volts, for example, 3.3 V.

When ink overflows from the gutter, for example on account of projections of ink, then comes into contact with the conductive element 20 and the exterior edge 14, the voltage at the terminals of the conductive element varies, translating a variation in impedance. The same is true in the case where ink, coming from one or several jets, is not recovered by the gutter and is projected onto the exterior edge 14. In an alternative, in order to detect a variation in impedance, a current detection could be implemented instead of a voltage variation detection.

This is notably the case (FIG. 2A) if the gutter is made of conducting material which is connected, for example, to earth (V=0V) or to a constant potential different to the potential applied to the conductive element 20. In an alternative, the insulating element 22 which separates the conductive element 20 from the exterior surface 14 has a certain extension around the conductive element 20, which ensures, for a stain of ink 21 of an extent less than that of said insulating element 22, a contact, both with the latter and with the conductive element 20.

This is also the case (FIG. 2B) if the gutter is made of a non-conducting material, a drop or a stain of ink 21 that comes into contact, both, with the conductive element 20 and with the exterior surface 14 of the gutter is going to make the impedance of the conductive element vary; the voltage measured at its terminals is thus going to vary.

In an alternative, the device comprises 2 electrodes 20, 20*a* (the latter being represented in broken lines in FIGS. 2A and 2B), to the terminals of each of which may be applied a potential difference (ddp); these ddp may be different; the detection of a variation of two ddp, which translates here as well a variation in impedance (more precisely, in this case, a short-circuit occurs, which leads to a zero difference in impedance between the two conductors), being ensured when an electrode or dirt comes into contact with the two electrodes simultaneously.

In the different cases envisaged, a circuit, which may be contained in the set of means, or circuit, 16, which make it possible to detect a variation in the voltage at the terminals of the conductive element 20, and/or of the conductive element 20*a*. A view of a gutter according to another aspect of the invention is explained in a more detailed manner below, in relation with FIG. 3. Numerical references identical to those of the preceding figures designate the same elements.

This time, a resistance, or, more generally, an electrode or a conductive element 30 is arranged between the gutter 7 and the cover 28 of the print head, said cover may be connected to earth (V=0V). This electrode or conductive element is arranged at a distance of the gutter 7 and of the cover 28.

As in the preceding case, to the terminals of the conductive element 30 may be applied a polarisation voltage Vc by means of power-on means, or a circuit, 16. These means, or this circuit, may comprise other elements, as explained below for measuring a variation in impedance, which results, here, in a variation in the voltage at the terminals of the conductive element 30, when ink is in contact with the latter. The polarisation voltage Vc may be of the order of several volts, for example, 3.3 V.

When ink 21 overflows from the gutter, for example on account of projections, then flows to the outside thereof and comes into contact, both, with the conductive element 30 and with the cover 28, the impedance of the conductive element varies, as does the voltage at its terminals. The same is true in the case where ink 21, coming from one or several jets, is not recovered by the gutter and comes, here again, into contact with the conductive element 30 and with the cover 28.

Figure 4A:
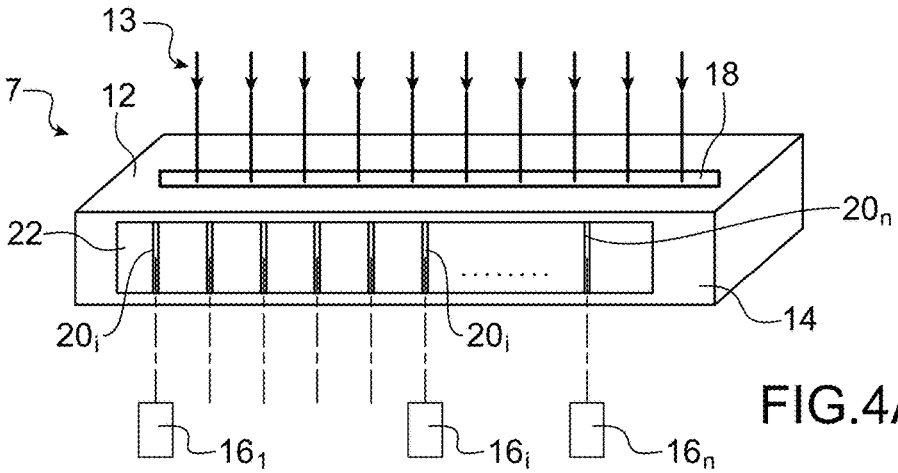
FIGS. 4A and 4B represent alternatives of the structures of FIGS. 2A and 2B.

An alternative of the embodiment explained above in relation with FIG. 2A is illustrated in FIG. 4A (here again, the same as in FIG. 4B, numerical references identical to those of the preceding figures designate therein the same elements): a plurality of n resistances, or electrodes, or conductive elements, $\mathbf{20}_1, \ldots \mathbf{20}_i, \ldots \mathbf{20}_n$ is arranged against the exterior surface 14 of the gutter (which is here made of a conducting material), each being separated from said exterior surface 14 by an insulating portion, for example in the form of a layer 22 of non-conducting material. These different conductive elements are preferably arranged parallel to each other or are aligned along the surface 14. To the terminals of each of these conductive elements $\mathbf{20}_i$ may be applied, by means $\mathbf{16}_i$, a voltage variable in frequency $f_i$ that is specific to it and which is different from the frequencies applied to the terminals of the other conductive elements. When ink flows on the exterior edge 14 of the gutter, for example on account of projections, then comes into contact with the conductive element 20; and the layer 22, the voltage at the terminals of this conductive element varies (which here again translates a variation in impedance). The same is true in the case where ink, coming from one or several jets, is not recovered by the gutter and flows onto the exterior edge 14 of said gutter. The frequency $f_i$ of this voltage being identified and associated with the conductive element $\mathbf{20}_i$, ink that flows on the exterior wall 14 of the gutter may be localised. In an alternative each electrode may be supplied by a constant voltage, but of variable amplitude from one electrode to the other, which also allows once again a localisation.

Another alternative, applied to the embodiment explained above in relation with FIG. 2B, may be realised: a plurality of n resistances, or electrodes, or conductive elements, $\mathbf{20}_1, \ldots \mathbf{20}_i, \ldots \mathbf{20}_n$ is arranged against the exterior surface 14 of the gutter (which is, this time, non-conducting). These different conductive elements are preferably arranged in a manner parallel to each other or are aligned along the surface 14. To the terminals of each of these conductive elements $\mathbf{20}_i$ may be applied, by means $\mathbf{16}_i$, a voltage variable in frequency $f_i$ that is specific to it and which is different from the frequencies applied to the other conductive elements. Here again, when ink flows onto the exterior edge 14 of the gutter, for example on account of projections, then comes into contact with the conductive element $\mathbf{20}_i$ and the exterior edge 14, the impedance of the conductive element (and thus the voltage applied to its terminals) varies. The same is true in the case where ink, coming from one or several jets, is not recovered by the gutter and flows onto the exterior edge of said gutter. The frequency $f_i$ (or the amplitude in the alternative exposed above) of this voltage being identified and associated with the conductive element $\mathbf{20}_i$, the localisation of the ink that flows along the gutter is easy.

Figure 4B:
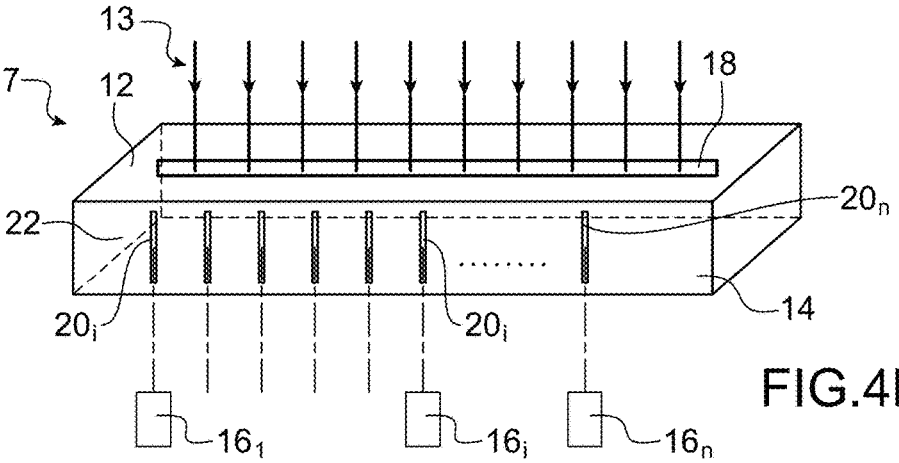

In the alternatives that have just been explained in relation with FIGS. 4A and 4B, for each alternating voltage applied to the terminals of one of the electrodes $\mathbf{20}_i$ (i=1 . . . n), preferably a variable voltage of zero average value will be chosen to avoid phenomena of transformation of the physical-chemical properties of the ink, such as for example the phenomenon of electrolysis.

If dirt or a drop of ink extends over several of the electrodes $\mathbf{20}_i$ (i=1, . . . , n), the identification of the different frequencies concerned (or the identification of the different amplitudes concerned in the alternative described above) makes it possible to localise the dirt or the drop spatially.

Figure 3:
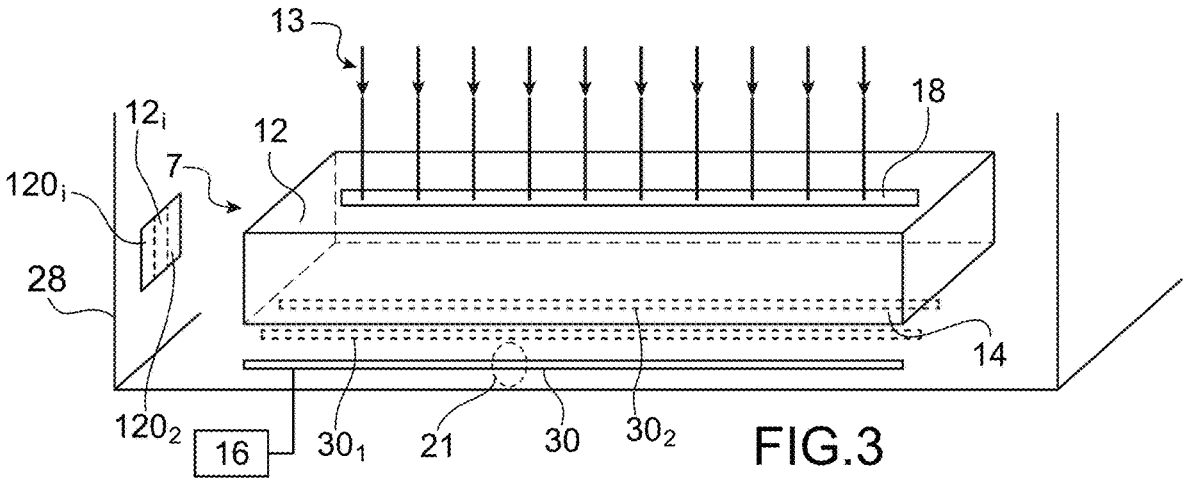
FIG. 3 represents another gutter according to the invention.

In the case of the embodiment of FIG. 3, several electrodes 30, $\mathbf{30}_1$, $\mathbf{30}_2$, may be arranged between the gutter 7 and the cover 28 of the print head, for example parallel to each other; to their terminals are for example applied different voltages in frequency and/or in amplitude in order to make it possible, in a similar manner to what is explained above, to identify the localisation of potential dirt or a drop of ink.

It is possible to combine one of the embodiments of FIGS. 2A, 2B, 4A, 4B with that of FIG. 3 or its alternative that has just been described above. This embodiment is not represented in the figures.

Figure 5A:
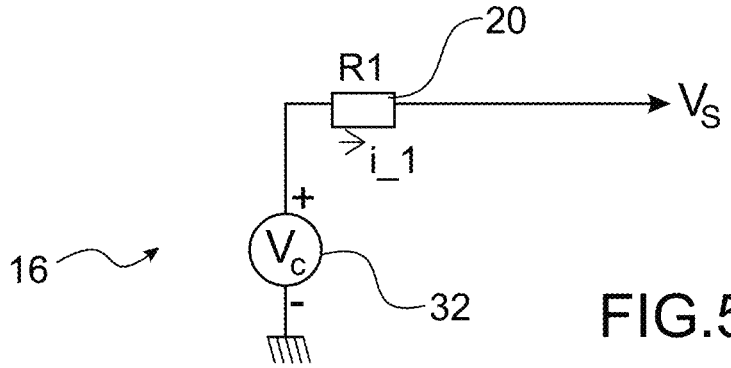
FIGS. 5A and 5B represent electrical connection diagrams of a detection device according to the invention, without dirt or overflow (FIG. 5A) and with dirt or overflow (FIG. 5B)
Figure 5B:
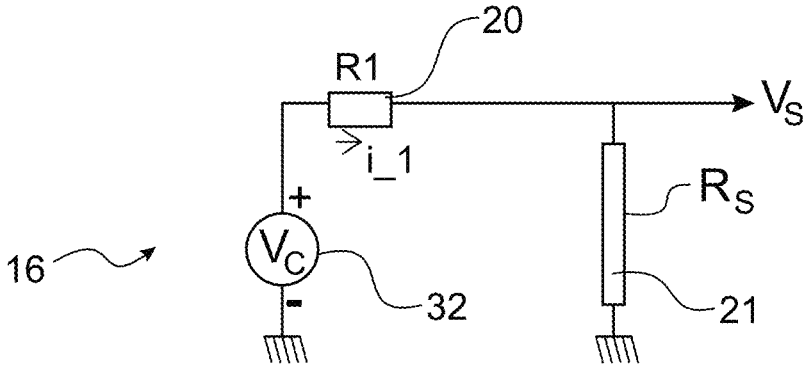

In FIGS. 5A and 5B (in which the gutter is not represented) is schematically represented a circuit 16 comprising a supply by a source 32 of continuous voltage Vc, for example 3.3 V, of a conductive element 20, having a resistance of value R1:

- in the absence of overflow or dirt (FIG. 5A), the output voltage $V_s$ measured is $V_s=V_c$;
- in the presence of overflow or dirt (FIG. 5B), which ends up in a stain of ink 21 which covers both a part of the conductive element 20 and a part of the wall of the gutter (or the insulating element 22), the output voltage $V_s$ measured is $V_s=Vc\cdot(Rs/(R1+Rs))$; where Rs is the resistance of the drop or the dirt.

According to an alternative, the continuous voltage source of the circuit 16 may be replaced by an alternating voltage source.

A circuit of the type of FIGS. 5A and 5B, or comprising an alternating voltage source, may be applied to any electrode 20, $\mathbf{20}_i$ (i=1 . . . n), 30, $\mathbf{30}_i$ (i=1 . . . n), of any one of FIGS. 2A-4B.

In all cases, detection means, not represented in these figures, make it possible to detect variations in impedance of the conductive element or conductive elements concerned, via variations in $V_s$. Such detection means comprise for example a current supply which supplies a current to said conductive element(s); voltage at terminals of said conductive element(s) can be measured (for example with a voltmeter) which mirror the impedance variations. Such detection means are for example in the form of an FPGA type circuit.

In the embodiments described above, an electrode 20, $\mathbf{20}_i$ (i=1 . . . n), 30, $\mathbf{30}_i$ (i=1 . . . n) may be arranged electrically in parallel with another electrode, itself arranged in the gutter and which makes it possible to detect the presence of ink therein.

Figure 6:
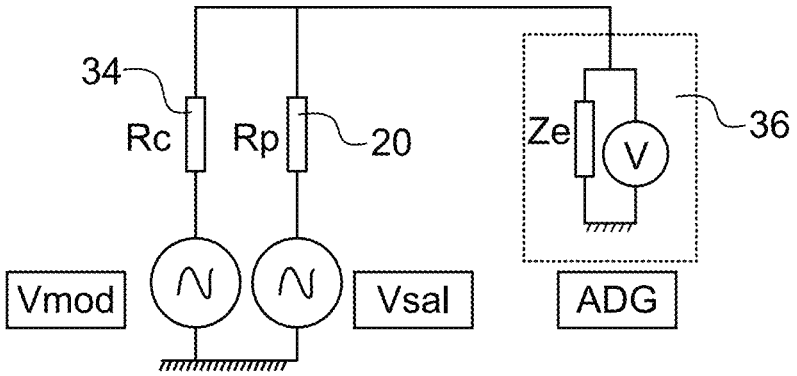
FIG. 6 represents an electrical connection diagram of a detection device according to the invention, in parallel with another device for detecting the presence of ink in a gutter.

Thus, in FIG. 6 is represented an electrode 20 (or in an alternative one of the electrodes $\mathbf{20}_i$ (i=1 . . . n), 30, $\mathbf{30}_i$ (i=1 . . . n)) arranged in parallel with an electrode 34. This electrode 20 makes it possible to identify the presence of ink against the exterior surface 14 of the gutter.

The electrode 20 may be supplied by an alternating voltage of frequency f, whereas the electrode 34 may be supplied by an alternating voltage of frequency f'.

The voltages of frequencies f and f' may be chosen in such a way as to be able to evaluate or measure the value of the two resistances 20 and 34 during a same acquisition. For example, the frequency f is chosen equal to half of the frequency f'; a same recognition algorithm may then be used to detect the two signals, only the frequency parameter being modified. In practice an acquisition is made and the recognition algorithm is executed twice on the acquired sample table. For example, an Intel 4040 microprocessor may be used as divider to obtain the signal at the frequency f'; it is possible to use the following output and two resistances mounted as a divider to obtain the signal at the frequency f. In FIG. 6, the reference 36 designates acquisition and processing means, realised for example in the form of a gain amplifier.

A method for detecting overflow of ink, from the ink recovery volume 13 to the exterior thereof, in particular to the surface 14, or the presence of ink projected against a zone exterior to said volume 13, in particular against said surface 14, may implement a device such as described above.

According to a method for detecting overflow of ink according to the invention, a voltage is applied to the terminals of at least one of the conductors 20, $\mathbf{20}_i$, 30, $\mathbf{30}_i$ and a variation in impedance of said conductor is measured, through a variation in voltage at its terminals when ink 21 comes into contact with this conductor.

A method for detecting overflow of ink according to the invention may be implemented during printing operations by means of the print head.

If a variation in voltage at the terminals of one of the conductors 20, $\mathbf{20}_i$, 30 is interpreted as translating the presence of ink 21 on at least one of them, an operator may intervene to clean the gutter, for example by interrupting the printing operations. To this end, a signal may be sent to the operator to indicate to it the presence of ink 21 to eliminate. If the device comprises a plurality of conductive elements as described above in relation with FIGS. 4A, 4B, this signal may also indicate the localisation of the ink 21 along the gutter.

In certain embodiments of the gutter, said gutter is moveable with respect to the remainder of the print head, for example under the action of a motor such as a step by step motor. This is notably the case when it is wished to move the gutter away from a path of the ink jets, for example after a test on the non-deviated jets, that is to say along a trajectory normally intended for printing.

Electrical means may be provided to detect the correct position of the gutter. These means for detecting the position of the gutter may be implemented in combination, or not, with the overflow detection means such as have been described above.

Figure 7A:
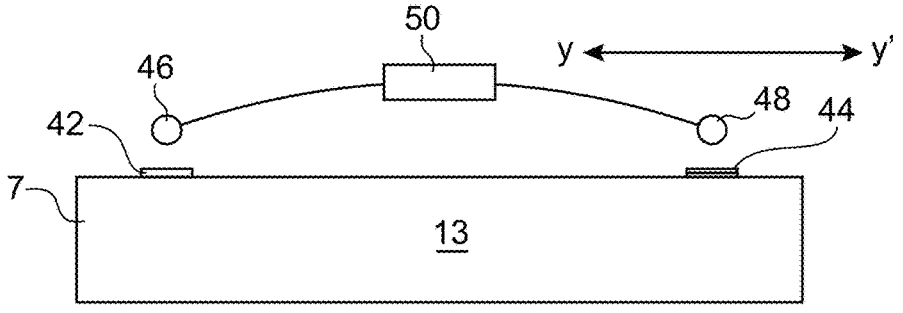
FIGS. 7A and 7B represent a system for detecting the position of a moveable gutter.

Thus, in FIG. 7A is represented the gutter 7, in top view (as previously, the reference 13 designates the interior volume of the gutter which makes it possible to collect a certain volume of ink). This gutter can make, under the action of movement means, not represented in the figure, for example a motor, in particular a step by step motor, a movement of a certain amplitude along an axis DD'.

Figure 7B:
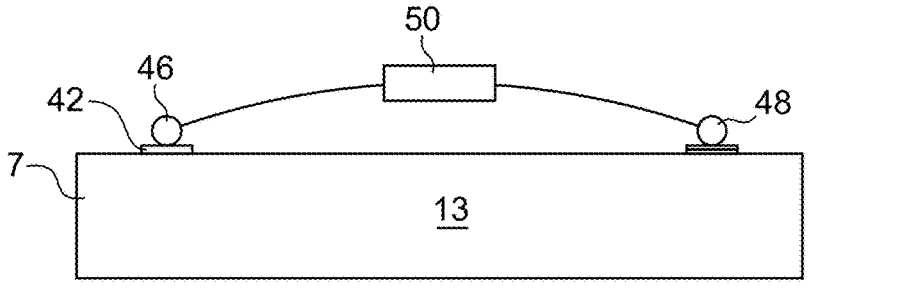

The gutter is equipped with two conductive elements 42, 44, which are fixed with respect to the gutter and which, when it is moved, come into contact with two other conductive elements 46, 48, which are fixed with respect to the print head. This situation is represented in FIG. 7B. In this embodiment, as in the following:

- the two conductive elements 42, 44 are preferably aligned along a perpendicular direction YY' substantially perpendicular to the direction DD' of movement of the gutter; the same is true for the two other conductive elements 46, 48;
- the two conductive elements 46, 48 may be elongated along a direction perpendicular to the plane of the figure and/or may be provided with contacts, or contact means, for example contact lugs, to come into contact with the conductors 42, 44.

In an alternative, the gutter may be provided with one only of the two conductive elements 42, 44, and the head of one only of the two conductive elements 46, 48, which comes into contact with the conductive element of the gutter in closed position. The use of two conductors 42, 44 and two conductive elements 46, 48 makes it possible to check the correct direction of movement with respect to the other elements of the head.

The two conductive elements 46, 48 may be connected to means 50 making it possible to establish an electrical circuit which is closed in contact position (FIG. 7B) and open in set-back position (FIG. 7A) of the gutter. When in contact position, the conductive element 46 comes into contact with the conductive element 42 and the conductive element 48 comes into contact with the conductive element 44. In an alternative, the circuit 50 could connect the elements 42 and 44.

Exemplary embodiments of the circuit 50 are given below.

Figure 8A:
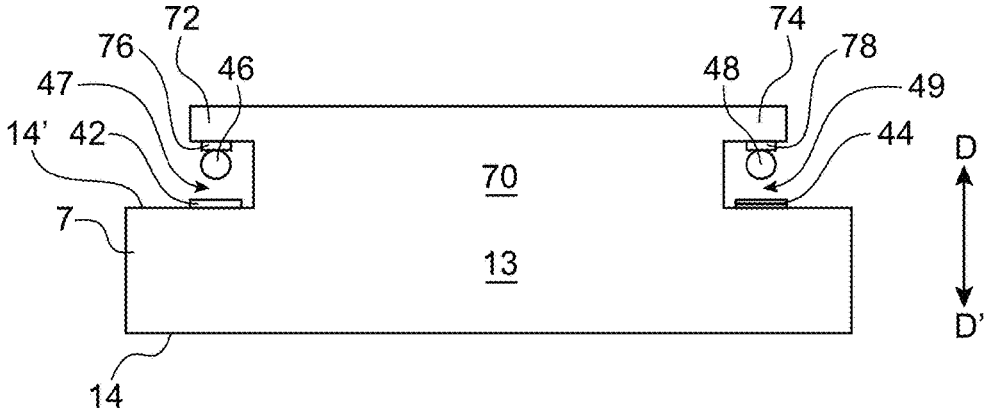
FIGS. 8A and 8B represent another system for detecting the position of a moveable gutter.

An alternative of this system is illustrated in FIG. 8A, in which the gutter, of which one face 14' has an extension or lug 70, which extends between the two conductors 46, 48; this extension which comprises side legs 72, 74, each of which is for example provided with a conductive element, or electrode, 76, 78; each of them may be arranged directly in contact with the side legs 72, 74, if they are made of a non-conducting material and can come into electrical contact with one of the conductors 46, 48 during the open position of the device. The circuit 50 is not represented in this FIG. 8A, but, when it is connected to the electrodes 46, 48, it makes it possible to detect the positioning of the gutter when said gutter reaches the open position represented in this figure; in the same way, it makes it possible to detect the positioning of the gutter when said gutter reaches the closed position represented in FIG. 8B.

Figure 8B:
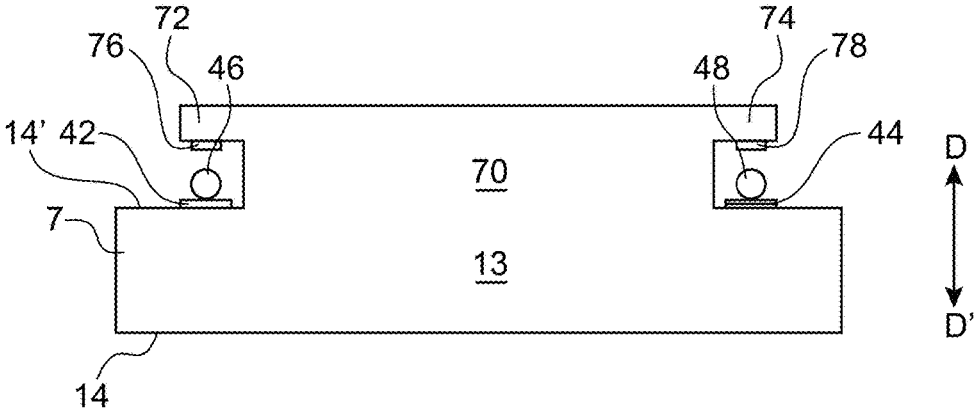

FIG. 8B represents the device in closed position: the conductors 46, 48 are then again in contact with the conductive pads 42, 44, as in FIG. 7B.

The circuit 50 and the set of conductive pads or electrodes 42, 44, 46, 48 may be provided so that the signal produced, in open position (FIG. 8A) is different from that produced in closed position (FIG. 8B), which then makes it possible to discriminate the open position of the gutter from the closed position.

The conductive elements 42, 44, respectively 76, 78 may be arranged directly in contact with the gutter, respectively the side legs 72, 74, if all these parts are made of a non-conducting material. If not, an insulating element such as the layer 22 (FIG. 2A, 4A) is arranged between each of them and the gutter. In an alternative, if the gutter is made of conducting material, the conductive elements 76, 78 can come directly into contact with a wall of the gutter 7, without implementing any conductive element 42, 44.

To detect the position of the gutter, the change of a voltage Vs is monitored, measured at the output of the electrode 48 when the electrode 46 is at a zero voltage. Initially, in the position of FIG. 8A, Vs=0V because 46 and 48 are at the same potential (they are connected by a circuit which is closed). If the gutter is moved, the contact between the two electrodes 46 and 48 is broken and the voltage Vs is going to change, for example to Vs=3.3V. It is possible, from this change, to deduce that the gutter is in intermediate position (between the positions of FIGS. 8A and 8B). Next, the gutter has the position represented in FIG. 8B and Vs=0V once again.

The exterior surface 14', the part 70 and the side legs 72, 74 make it possible to define spaces 47, 49 delimited in a "U" shape, in which the conductors 46, 48 are arranged and face the conductive elements 42, 76 and 44, 78, which come and go with respect to the conductors 46, 48, as a function of the movement of the gutter along the axis DD'.

The means for detecting the position of the gutter, which have been described above, in particular in relation with FIGS. 7A-7B, 8A-8B, may be used independently of the means for detecting overflow and dirt which have been described above, in relation with FIGS. 2A-6, or which are described below, in the case of a capacitive measurement, in particular in relation with FIGS. 11A-11D.

According to an alternative, which combines an embodiment of detection of overflow or presence of dirt and a detection of position of the gutter, the latter has, apart from the conductive pads 42, 44, one or more electrode(s) or conductive element(s) 20, $\mathbf{20}_i$, 30, $\mathbf{30}_i$ for detecting overflow or dirt, as explained above, notably in relation with FIGS. 2A-4B.

Figure 9:
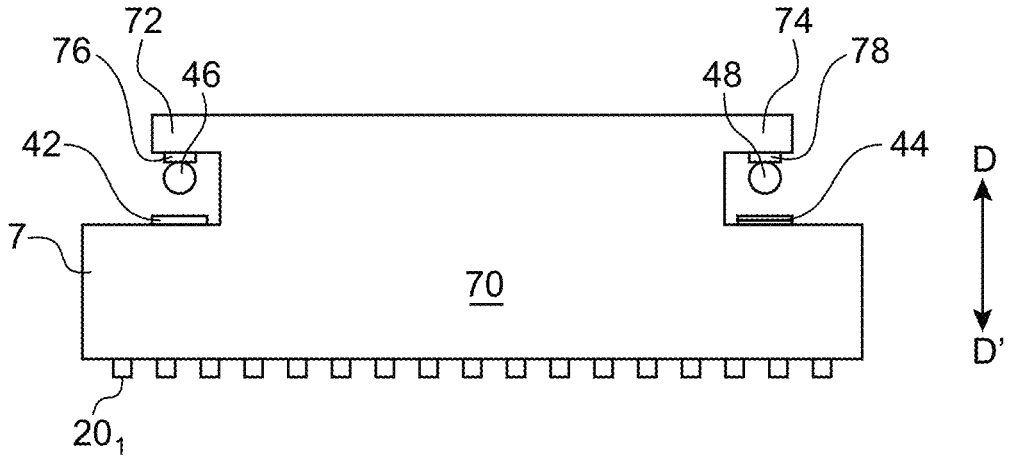
FIG. 9 represents another system for detecting the position of a moveable gutter, which is also provided with means for detecting dirt or overflows.

Such a configuration is represented in FIG. 9, where the numerical references have the same significations as in the preceding figures. This configuration combines the conductive pads 42, 44 of FIGS. 7A-8B and the conductive elements $\mathbf{20}_i$ of FIG. 4B. Here again, the corresponding circuits $\mathbf{16}_i$ (i=1, . . . n), 50 are not represented but may be connected to the electrodes or to the corresponding conductive elements.

An alternative (not represented) combines, in the case of a gutter made of conducting material, the embodiment of FIGS. 8A-8B, with the electrodes 20, $\mathbf{20}_i$ of FIGS. 2A-4A, separated from the wall of the gutter by the insulating element 22.

In these alternatives, one of the conductive tracks 42, 44 may form a, or be a part of a, conductive element for detecting drops or dirt, arranged on the exterior wall 14 of the gutter as explained above in relation with FIGS. 2A, 2B, 4A, 4B.

For example, one at least of the conductive tracks 42, 44 may be the extension of an electrode or a conductive element 20, $\mathbf{20}_i$ of one of the configurations described above in relation with FIGS. 2A, 2B, 4A, 4B: at least one electrode or at least one conductive element 20, $\mathbf{20}_i$ may be arranged on an exterior face 14 of the gutter, whereas the conductive tracks 42, 44 are arranged on one face 14', opposite to the face 14 according to the axis of movement DD'.

Another alternative (also not represented) combines the embodiment of FIGS. 8A-8B, with one or several electrodes 30, $\mathbf{30}_i$ of FIG. 3, which may be provided with their circuit 16, $\mathbf{16}_i$.

Figure 10A:
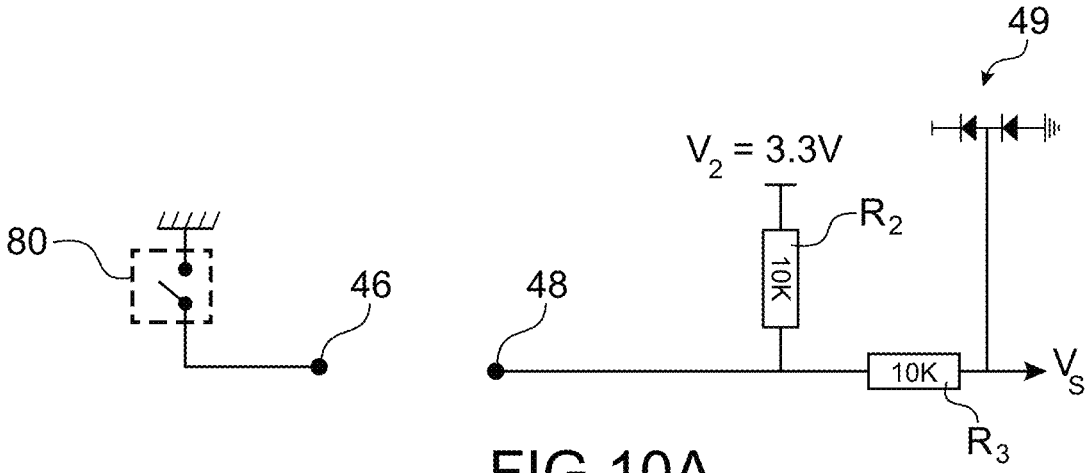
FIGS. 10A and 10B represent electrical connection diagrams of a device for detecting the position of a moveable gutter according to the invention, an electrode of this device also forming part of means for detecting dirt or overflows, according to the invention.
Figure 10B:
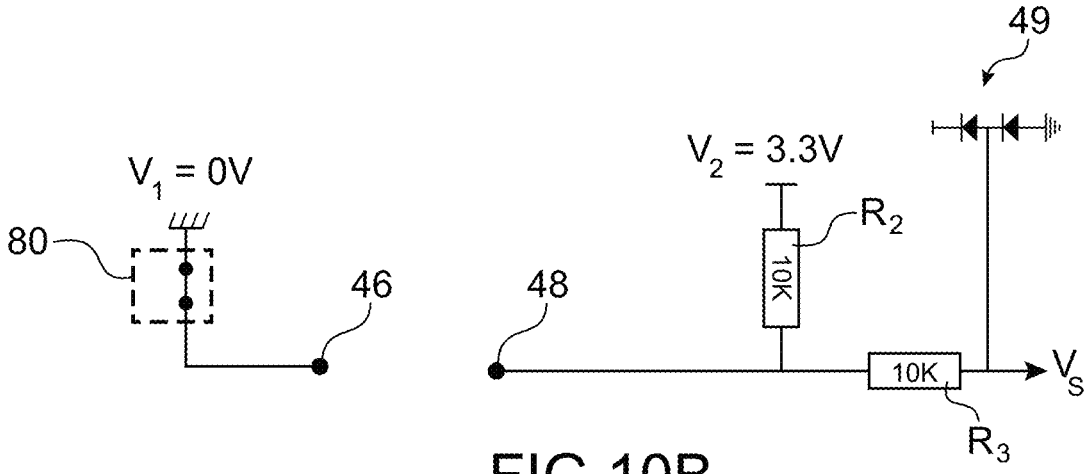

An exemplary embodiment of the circuit which connects the conductive elements 46, 48 is represented in FIGS. 10A and 10B (in which the gutter is not represented), for the case where one of these conductive elements (here the conductive element 48) also plays a role in the detection of overflow of ink or dirt; in other words, one these conductive elements (here the conductive element 48) is common to the means or to the device for detecting the position of the gutter and to the means or to the device for detecting overflow or the presence of ink on an exterior surface 14 of the gutter.

In these FIGS. 10A and 10B, the conductive element 46 is connected to a switch 80 (realised for example by means of an MOS transistor) which is switched to the open state (FIG. 10A) when only the function of detection of overflow is implemented, the system being for example in the "closed" position of FIGS. 7B and 8B); in this open state of the switch 80, the conductive element 46 is at a floating potential. The switch 80 is switched to the closed state (FIG. 10B) when the position detection function is used; in this closed state of the switch 80, the conductive element 46 is at a potential imposed, for example, by earth (0 V). The switch 80 may be commanded, by opening or by closing, by means of a voltage of, for example, 3.3 V.

The conductive element 48 is also supplied by a voltage supply, or by voltage supply means, not represented in the figure, through a resistance R2 (for example: 10 kΩ); it is for example taken to a constant voltage of several volts, again for example 3.3 V. In parallel, a track makes it possible to measure an output signal Vs, through a resistance R3 (for example: 10 kΩ). This output signal may be sent to a circuit of FPGA type for analysis. The element 49 represented in FIGS. 10 A and 10 B is a protective element, for example realised by means of one or several diodes, to avoid any output voltage Vs overvoltage.

In the case where only the overflow detection function is implemented (FIG. 10A: the switch 80 is open) a floating voltage is applied to the conductive element 46:

- if no overflow is detected by means of the conductive element 48, an output voltage signal equal to around V2 is detected;
- if an overflow is detected by means of the conductive element 48, an output voltage signal equal to around 0 V is detected.

In the case where the position detection function is used (FIG. 10B):

- if the gutter is positioned correctly, the electrical connection between the conductive elements 46 and 48 is ensured, an output voltage signal equal to around 0V is detected;
- if the gutter is not positioned correctly, or if the "closed" position has not yet been reached, the electrical connection between the conductive elements 46 and 48 is not assured, and an output voltage signal equal to around V2 is detected.

Switching means 80 thus make it possible to use the pair of electrodes 46, 48 with a view to the detection of the position of the gutter, then to use at least one of these electrodes with a view to the detection of overflow or dirt on the walls of the gutter.

In the examples given above, in relation with FIGS. 2A-6, a variation in impedance is obtained following the electrical contact that is established between at least one drop of ink 21 and at least one conductor 20, $\mathbf{20}_i$, 30, $\mathbf{30}_i$.

Figure 11A:
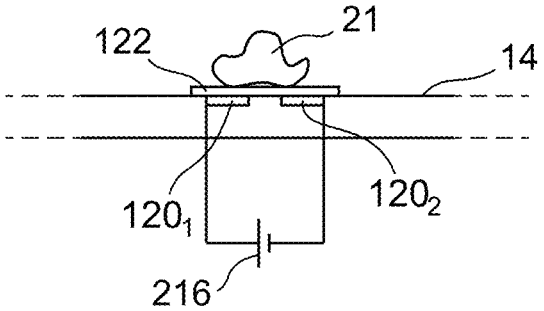
FIGS. 11A-11D represent another embodiment of the invention, with a capacitive operation.

According to an alternative, illustrated in FIG. 11A (which only represents a part of the gutter, the remainder of said gutter being identical or similar to what has already been described above in relation with FIGS. 2A-4B), 2 conductive elements $\mathbf{120}_1$, $\mathbf{120}_2$ are arranged in a wall of the gutter against which ink may, for the reasons already outlined above, be deposited. Preferably, they are flush on the exterior surface 14 of the gutter. In an alternative (FIG. 11B), these 2 conductive elements $\mathbf{120}_1$, $\mathbf{120}_2$ are against the wall 14 of the gutter 7.

In both cases, the two conductive elements are isolated with respect to each other and are covered with a layer 122 of insulating material. They thereby form a capacitance, or a capacitive sensor, with this layer. Means (for example a voltage supply) 216 make it possible to maintain a potential difference between the two conductive elements $\mathbf{120}_1$, $\mathbf{120}_2$. When a drop of ink 21 is deposited against the layer 122, the dielectric properties of the capacitance are modified and it varies; a variation in the capacitance, and thus in the impedance, is measured by means of a capacitance reading measurement device, for example realised from a circuit of Texas Instruments, of FDC 1004 4, Channel Capacitance to Digital Converter for Capacitive Sensing Solution type. For example, such a device implements a digital converter of capacitance values. The digital data may be memorised and compared to reference data and/or processed to evaluate a variation in capacitance.

Various possible configurations of distribution or arrangements of the conductive elements $\mathbf{120}_1$, $\mathbf{120}_2$ are possible; it is possible notably to use several capacitive sensors arranged as for example in FIG. 2A-4B, along the exterior wall of a recovery gutter or, more generally, arranged inside a print head, for example, against the interior surface of the cover of the head.

Figure 11B:
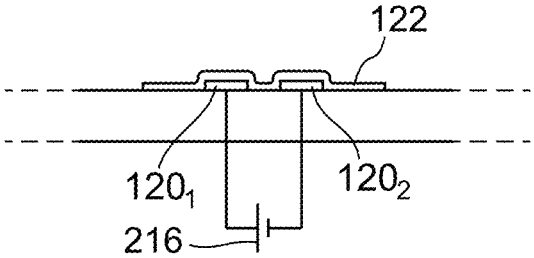
Figure 11C:
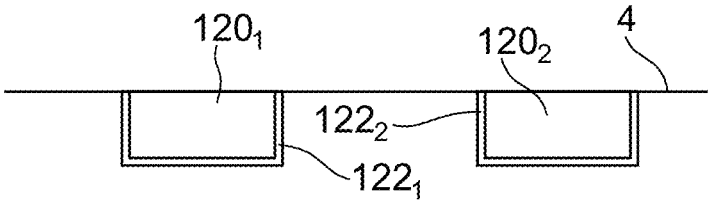
Figure 11D:
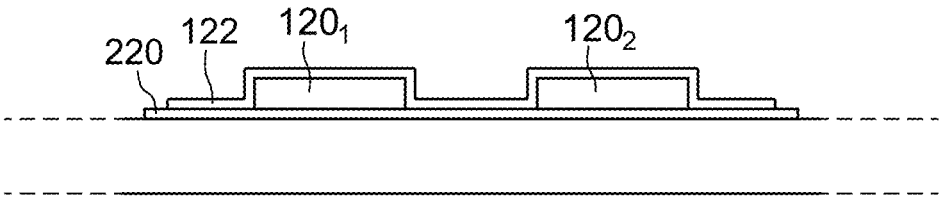

It is possible, in an alternative, to use an electrode $\mathbf{120}_1$, the other electrode being formed by a conductive element, for example the gutter itself, connected to earth or to any reference voltage. When the gutter is made of a non-electrically conducting material, the conductive element(s) $\mathbf{120}_1$, $\mathbf{120}_2$ is or are arranged in one or more specific housing(s) $\mathbf{121}_1$, $\mathbf{121}_2$ (FIG. 11A) or directly against the wall 14 of the gutter (FIG. 11B).

When the gutter is made of an electrically conducting material, the conductive element(s) $\mathbf{120}_1$, $\mathbf{120}_2$ is or are arranged in this or these housing(s) (FIG. 11A, 11C), but the bottom of this or these housing(s) is covered with a layer $\mathbf{122}_1$, $\mathbf{122}_2$ of insulating material. In the alternative of FIG. 11B, the conductive element(s) $\mathbf{120}_1$, $\mathbf{120}_2$ is or are separated from the exterior surface 14 by an insulating portion 220 (FIG. 11B, 11D), for example in the form of a layer of non-conducting material applied against the surface 14. The conductive element(s) is or are applied against this insulating portion 220, which has a certain lateral extension on the sides of these conductive elements.

The embodiment that has just been described above in relation with FIGS. 11A-11D may be combined with means for detecting the position of the gutter, as described above in relation with FIGS. 7A-9. In particular, at least one of the conductors 42, 44 of the latter may be the extension of one of the conductors $\mathbf{120}_1$, $\mathbf{120}_2$ described above.

The detector, or the detection means, whether it is or they are of capacitive or resistive type, described above in relation with the detection of ink deposited on the exterior surface of a gutter may be applied at other places inside the print head with a view to detecting the projection of ink therein.

In other words, it is possible to apply, against any wall arranged inside the print head and capable of receiving projections of ink, for example an interior surface of the cover 28 (see FIG. 3 in which is represented the layer 122 and the 2 conductive elements $\mathbf{120}_1$, $\mathbf{120}_2$ that it covers; the means 216 are not represented in this figure), one or several conductive elements 20, $\mathbf{20}_i$, 30, $\mathbf{120}_1$, $\mathbf{120}_2$, such as described above with a voltage supply or voltage supply means and a detector, or means for, detecting the variation in voltage or, more generally, impedance. The detection of the presence of ink is then carried out in the same way as what has been described above: whether the conductive element(s) is or are of resistive or capacitive type, a variation in impedance is detected when ink is present in contact with the resistive element(s) or ink or solvent with an element that forms the dielectric of a capacitance.

One or several conductors 20, $\mathbf{20}_i$, 30, $\mathbf{120}_1$, $\mathbf{120}_2$, may also be arranged between the gutter and the nozzle plate 2 (see FIG. 1). This or these conductors are connected to suitable detection means, for example of the type already described above.

A print head structure 10 to which the invention may be applied has already been described above in relation with FIG. 1. The whole is contained within a cover which has been represented schematically in FIG. 3 and which is designated by the reference 28. This cover may form a potential or earth reference. It should be specified that a plurality of gutters may be used in a same print head.

Figure 12:
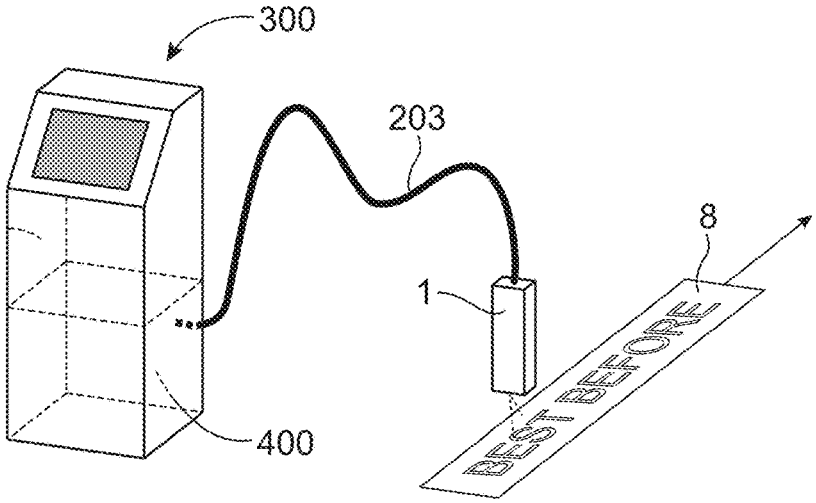
FIG. 12 represents the main blocks of an ink jet printer.

In FIG. 12 are represented the main blocks of an ink jet printer that comprises a print head 10, which can implement a head according to one or several of the embodiments described above. The printer comprises its console 300, a compartment 400 notably containing circuits for conditioning ink and solvents, as well as reservoirs for ink and solvents (in particular, the reservoir to which the ink recovered by the gutter is returned). Generally, the compartment 400 is in the lower part of the console. The upper part of the console comprises the command and control electronics as well as visualisation means (a screen or a display for example). The console is hydraulically and electrically connected to a print head 100 via an umbilical 203.

A gantry (more generally: maintaining means), not represented, make it possible to install the print head facing a printing support 8, which moves along a direction materialised by an arrow. This direction is for example perpendicular to an alignment axis of the nozzles. The print head is maintained at a distance from the printing support 8 which may be at least equal to 4 mm or 5 mm. The printing support 8 may have a non-flat surface, in which case the gantry (or, more generally, the maintaining means) may be commanded in such a way as to maintain the print head at a suitable distance as a function of the geometry of the support 8.

A device according to the invention is supplied with ink by a reservoir of ink not represented in the figures. Various fluidic or hydraulic circuit(s) or connection means may be implemented to connect this reservoir to a print head according to the invention, and for recovering ink that comes from the recovery gutter. An example of complete circuit is described in U.S. Pat. No. 7,192,121 and may be used in combination with the present invention.

Whatever the envisaged embodiment, the instructions, for activating the means $\mathbf{4}_1$-$\mathbf{4}_n$ for producing ink jets and/or means for pumping the gutter, may be sent by control means (also called "controller") of a printer. It is also these instructions that are going to make it possible to make pressurised ink circulate in the direction of means $\mathbf{4}_1$-$\mathbf{4}_n$, then to generate the jets as a function of the patterns to print on a support 8. These control means are for example realised in the form of a processor or a microprocessor, programmed to implement a method according to the invention.

It is this controller that controls the means $\mathbf{4}_1$-$\mathbf{4}_n$, the means for pumping the printer, and in particular the gutter, as well as the opening and the closing of valves on the path of the different fluids (ink, solvent, gas). These control means can also ensure the memorisation of data, for example data of measuring ink levels in one or more reservoirs, and their potential treatment.

More generally, control means, for example realised in the form of a processor or a microprocessor, are programmed to implement a method according to the invention.

These control means may ensure the processing of the signals Vs measured within the scope of the present invention, in particular the signals of variation in voltage which translate a variation in impedance; these same means may enable, potentially, the sending of signals, with a view to a display, to an operator, for a visualisation, on visualisation means or a screen or display, notably during the appearance of a defect, in particular during the detection of ink, according to the invention, at inappropriate places (interior surface of the head, or exterior surface of the gutter).

These control means may interpret a variation in impedance of at least one of the detection conductors 20, $\mathbf{20}_i$, 30 or $\mathbf{120}_1$, $\mathbf{120}_2$ as translating the presence of ink 21 on at least one of them. If the device comprises a plurality of conductive elements as described for example above in relation with FIGS. 4A, 4B, these control means can send a signal, for example with a view to a display or a visualisation on said visualisation means or screen, to indicate the localisation of the ink 21 along the gutter.

The invention is particularly interesting in applications where the print head comprises several nozzles, for example 64 nozzles, but the invention also applies to the case of a nozzle plate with a lower number of nozzles, for example 32, or in the case of a higher number of nozzles, for example 128.

Among the continuous ink jet printers concerned by the invention may notably be distinguished deviated continuous ink jet printers and binary continuous ink jet printers.

In deviated continuous ink jet printers, the drops formed from a nozzle (such as one of the nozzles 4 of FIG. 1) throughout the duration of printing of a position of a printing support 8 (FIG. 1) are deviated or not deviated. For each printing position and for each nozzle, a segment perpendicular to the direction of movement of the printing support is printed. The deviated drops are deviated in such a way as to strike the printing support on the part of the printed segment that has to be printed taking account of the pattern to print. The non-deviated drops are recovered by the recovery gutter 7. Deviated continuous ink jet printers comprise in general few ejection nozzles 4, but each nozzle can print for each printing position of the support 8 several pixels spread out on the printing segment as a function of the pattern to print.

In binary continuous ink jet printers, the ink coming from a nozzle 4 only prints one pixel per printing position. The pixel considered does not receive any drop or receives one or several drops, as a function of the pattern to print. Hence, for good printing rapidity, the nozzle plate comprises a large number of nozzles 4, for example 64, enabling the simultaneous printing of as many pixels as nozzles. The drops not intended for printing are recovered by the recovery gutter 7.

The control means of the printer are adapted to one or the other of these types of printer (deviated continuous jet, binary continuous jet).

Figure 13:
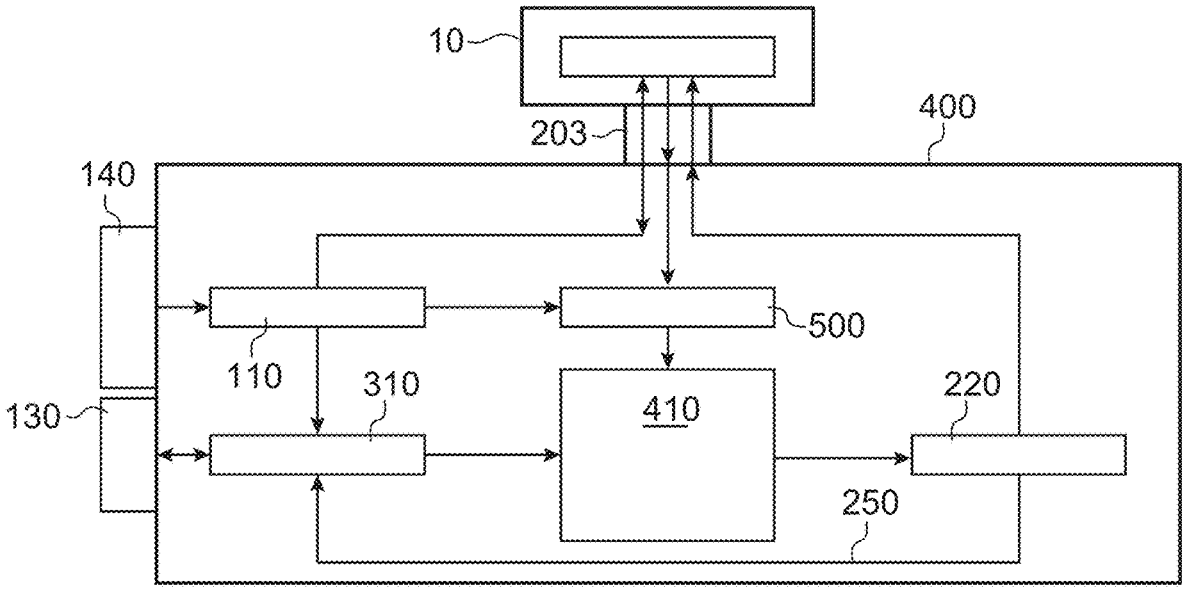
FIG. 13 represents a structure of an ink jet printer to which the present invention may be applied.

An example of fluidic circuit 400 of a printer to which the invention may be applied is illustrated in FIG. 13. This fluidic circuit 400 comprises a plurality of means 410, 500, 110, 220, 310, each associated with a specific functionality. The head 10 and the umbilical 203 are also present once again.

With this circuit 400 are associated a removable ink cartridge 130 and a solvent cartridge 140, also removable.

The reference 410 designates the main reservoir, which makes it possible to collect a mixture of solvent and ink.

The reference 110 designates the set of means, or the hydraulic circuit, that make it possible to withdraw, and potentially store, solvent from a solvent cartridge 140 and to supply the ink thereby withdrawn to other parts of the printer, whether it involves supplying the main reservoir 410 with solvent, or cleaning or maintaining one or several other parts of the machine.

The reference 310 designates the set of means, or the hydraulic circuit, that make it possible to withdraw ink from a cartridge 130 of ink and to supply the ink thereby withdrawn to supply the main reservoir 410. As may be seen in this figure, according to the embodiment described here, the sending of solvent, to the main reservoir 410 and from the means 110, goes through these same means 310.

At the outlet of the reservoir 410, a set of means, or a hydraulic circuit, globally designated by the reference 220, makes it possible to pressurise the ink withdrawn from the main reservoir, and to send it to the print head 10. According to one embodiment, illustrated here by the arrow 250, it is also possible, by these means 220, to send ink to the means 310, then again to the reservoir 410, which enables a recirculation of ink inside the circuit. This circuit 220 also makes it possible to empty the reservoir in the cartridge 130 and to clean the connections of the cartridge 130

The system represented in this figure also comprises means 500, or a hydraulic circuit, for recovering fluids (ink and/or solvent) which return from the print head, more exactly the gutter 7 of the print head or the circuit for rinsing the head. These means 500 are thus arranged downstream of the umbilical 203 (with respect to the direction of circulation of the fluids that return from the print head).

As may be seen in FIG. 7, the means, or the hydraulic circuit, 110 may also make it possible to send solvent directly to these means 500, without going through either the umbilical 203 or through the print head 10 or through the recovery gutter.

The means, or the hydraulic circuit, 110 may comprise at least 3 parallel supplies of solvent, one to the head 1, the $2^{nd}$ to the means 500 and the $3^{rd}$ to the means 310.

Each of the means, or each of the hydraulic circuits, described above is provided with means, such as valves, preferably electromagnetic valves, which make it possible to orient the fluid concerned to the chosen destination. Thus, from the means 110, it is possible to send exclusively solvent to the head 1, or to the means 500 or to the means 310.

Each of the means 500, 110, 210, 310 described above may be provided with a pump that makes it possible to treat the fluid concerned (respectively: $1^{st}$ pump, $2^{nd}$ pump, $3^{rd}$ pump, $4^{th}$ pump). These different pumps ensure different functions (those of their respective means) and are thus different to each other, even if these different pumps may be of same type or of similar types (in other words: none of these pumps ensures 2 of these functions).

In particular, the means 500 comprise a pump ($1^{st}$ pump) which makes it possible to pump the fluid, recovered, as explained above, from the print head, and to send it to the main reservoir 410. This pump is dedicated to the recovery of fluid coming from the print head and is physically different from the 4th pump of the means 310 dedicated to the transfer of ink or the $3^{rd}$ pump of the means 210 dedicated to the pressurisation of ink at the outlet of the reservoir 410.

The means 110 comprise a pump (the $2^{nd}$ pump) which makes it possible to pump solvent and to send it to the means 500 and/or the means 310 and/or to the print head 10.

Such a circuit 400 is controlled by the control means described above, these means are in general contained in the console 300 (FIG. 12).

The printers to which the invention may be applied are notably industrial printers, for example of the type of those that can print non-flat surfaces, for example on cables or bottles or cans or, more generally, containers, for example of the type having a curvature or a curved surface, notably tins or flasks or pots. According to another aspect relative to such printers, the distance between the print head and the printing support is greater than that of normal office printers. For example this distance is at least equal to 4 mm or 5 mm for a CIJ printer.

Another aspect of these printers is their speed: their maximum possible speed may be comprised between 10 and 15 m/s.

Another aspect of these printers is their aptitude to print on very different surfaces, for example on glass or metal or "blisters" or packaging materials.

The invention claimed is:

1. Print head of a continuous ink jet printer comprising, in a cover:

at least one nozzle for ejecting at least one fluid jet in a jet direction;

at least one electrode for separating drops or sections of the at least one fluid jet, intended for printing, from drops or sections not intended for printing;

a slot, open to the outside of the print head and enabling the drops or sections intended for printing to get out;

a recovery gutter, for recovering the drops or sections not intended for printing, said recovery gutter comprising a recovery volume;

at least one conductive detection element, arranged inside the print head:

against an interior surface of the cover;

against a surface of the recovery gutter, exterior to the recovery volume, said at least one conductive element being able to receive overflows of fluid from the recovery gutter; or at a distance from the recovery gutter in the jet direction; and a detector of a variation in impedance of said at least one conductive detection element, when charged or non-charged fluid is present in contact therewith or with a dielectric layer in contact therewith.

2. Print head according to claim 1, at least one of said conductive detection element forming a resistive impedance.

3. Print head according to claim 2, comprising a voltage supply to the terminals of said at least one conductive detection element, a variation in this voltage translating a variation in impedance of said at least one conductive detection element.

4. Print head according to claim 1, said at least one conductive detection element forming, with another conductive element, a capacitive impedance.

5. Print head according to claim 4, comprising a supply voltage to the terminals of said capacitive impedance, a variation in this voltage translating a variation in impedance of said capacitive impedance.

6. Print head according to claim 1, the recovery gutter further comprising at least one further conductive element for identifying the presence of fluid in the recovery gutter, said further conductive element being mounted in parallel with said at least one conductive detection element.

7. Print head according to claim 1, comprising wherein the at least one conductive detection element comprises multiple conductive detection elements, and the print head includes a voltage supply to supply each of the multiple conductive detection elements with a different voltage in amplitude and/or in frequency.

8. Print head according to claim 7, said detector making it possible to localise at least one of said multiple conductive detection elements of which the impedance varies.

9. Print head according to claim 1, said interior surface of the print head against which at least one conductive detection element is arranged being:

made of a non-electrically conducting material;

or being made of an electrically conducting material, said conductive detection element being arranged against a non-electrically conducting layer, itself arranged against or in said surface or arranged in one or several housings formed in said surface.

10. Print head according to claim 1, further comprising a motor moving the recovery gutter in the print head and an electrical contact detector detecting a position of the recovery gutter.

11. Print head according to claim 10, the electrical contact detector comprising at least one first conductive element, fixed with respect to the print head, which comes, in a 1st position of the recovery gutter, into contact with at least one conductive element, fixed with respect to the recovery gutter.

12. Print head according to claim 11, comprising:

at least one third conductive element, fixed with respect to the recovery gutter, which comes, in a 2nd position of the recovery gutter, different from said 1st position, into contact with at least one first conductive element, fixed with respect to the print head;

and/or at least one second conductive element, connected to a detector of a variation in impedance when fluid is present in contact with said at least one conductive detection element or with a dielectric layer in contact therewith.

13. Print head according to claim 12, comprising a switch switching at least one second conductive element which is fixed with respect to the recovery gutter, either as conductive element for detecting the position of the recovery gutter, or as conductive detection element for detecting the presence of fluid in contact with said second conductive element or with a dielectric layer in contact therewith.

14. Print head according to claim 1, comprising n nozzles for producing n fluid jets, with n=1 or n>1.

15. Print head according to claim 1, wherein the at least one conductive detection element is arranged against the interior surface of the cover.

16. Print head according to claim 1, wherein the at least one conductive detection element is arranged at the distance from the recovery gutter in the jet direction.

17. Print head of a continuous ink jet printer comprising, in a cover:

at least one nozzle for producing at least one fluid jet;

at least one electrode for separating drops or sections of the at least one fluid jet, intended for printing, from drops or sections not intended for printing;

a slot, open to the outside of the print head and enabling the drops or sections intended for printing to get out;

a recovery gutter, for recovering the drops or sections not intended for printing, said recovery gutter comprising a recovery volume;

a plurality of conductive detection elements, wherein each conductive detection element is arranged inside the print head:

against an interior surface of the cover;

against a surface of the recovery gutter, exterior to the recovery volume, such that the conductive detection element is able to receive overflows of fluid from the recovery gutter; or at a distance from the recovery gutter, between said recovery gutter and the cover or between said recovery gutter and the at least one nozzle;

a detector of a variation in impedance of said plurality of conductive detection elements, when charged or non-charged fluid is present in contact therewith or with a dielectric layer in contact therewith; and a voltage supply to supply each of the plurality of conductive detection elements with a different voltage in amplitude and/or in frequency.

* * * * *